US005088408A

United States Patent [19]

Philpot

[11] Patent Number: 5,088,408

[45] Date of Patent: Feb. 18, 1992

[54] PRINTING PLATE MOUNTING SYSTEM AND A PRINTING PLATE COMPOSITE UTILIZING SUCH SYSTEM

[75] Inventor: Ivan N. Philpot, Irving, Tex.

[73] Assignee: Matthews International Inc., Pittsburgh, Pa.

[21] Appl. No.: 662,727

[22] Filed: Feb. 28, 1991

[51] Int. Cl.[5] ..... B41F 27/00

[52] U.S. Cl. ..... 101/415.1; 101/378

[58] Field of Search ..... 101/376, 378, 382.1, 101/383-389, 415.1, 485, 486, DIG. 36

[56] References Cited

U.S. PATENT DOCUMENTS

| | | | |
|---|---|---|---|
| 2,704,025 | 3/1955 | Anderson et al. | 101/415.1 |
| 3,228,329 | 1/1966 | Mangus et al. | 101/378 |
| 3,295,443 | 1/1967 | Devon | 101/376 |
| 3,934,509 | 1/1976 | Saunders | 101/415.1 |
| 4,047,481 | 9/1977 | Saunders | 101/376 |

FOREIGN PATENT DOCUMENTS

| | | | |
|---|---|---|---|
| 1213861 | 4/1966 | Fed. Rep. of Germany | 101/415.1 |

OTHER PUBLICATIONS

Rogers Corporation News Release Introduction to Flexo Folder-Gluers, p. 161.

*Primary Examiner*—Edgar S. Burr
*Assistant Examiner*—Ren Yan
*Attorney, Agent, or Firm*—Armstrong, Nikaido, Marmelstein, Kubovcik & Murray

[57] ABSTRACT

This invention provides an apparatus for positioning and securing a printing plate to a printing plate cylinder. Such apparatus includes a sheet member having a bottom surface portion engageable with a working surface of such printing plate cylinder and an axially opposed upper surface portion. A plurality of apertures are formed through the sheet member across a width dimension and adjacent one edge thereof. A generally rigid reinforcing member is provided for each aperture thereby providing a requisite amount of reinforcement for the sheet member. A substantially J-shaped hook-like member is secured to the axially opposed upper surface portion of the sheet member for engagement with another member carrying a printing plate.

20 Claims, 2 Drawing Sheets

PRINTING PLATE MOUNTING SYSTEM AND A PRINTING PLATE COMPOSITE UTILIZING SUCH SYSTEM

FIELD OF THE INVENTION

The present invention relates, in general, to printing arrangements particularly useful in printing of substrate materials for packaging products and, more particularly, this invention relates to an improved printing plate mounting system that enables a printing plate composite to be quickly and easily secured to and removed from at least a portion of the working surface of a printing plate cylinder disposed in at least one print station located in the printing arrangement.

BACKGROUND OF THE INVENTION

During the past few years, in the retail sales industry, it has become the general practice to make use of what is known in the packaging industry as "point of sales" packaging for the majority of products offered for sale in a retail outlet. This practice, as generally believed would be expected, has forced the packaging industry to not only develop but also to implement new equipment and operating practices. Such new equipment and operating practices being necessary to provide significant improvement in the quality of printing. The former "brown box", in other words, would no longer be an acceptable package for products offered for sale at the retail level.

As a result, flexographic printing was introduced into the package printing industry. Such flexographic printing is in widespread use at the present time. For example, see an article that was published in the December, 1979, issue of "Box Board Containers". The title of this article is "It's Time for a Change in Flexo". Generally, as mentioned in this article, flexographic printing entered this area of use in the 1960's. It was at this time that converters began installing the necessary equipment to implement use of the flexographic printing process. With their new flexographic printing equipment, the converters could now print, slot, fold, glue, die-cut and bundle in a true production line manner.

This change in equipment to the flexographic printing process also offered the converters a potential for extended capabilities and other improvements in package printing. Such extended capabilities being in addition to all the advantages of such in line operations. However, these additional benefits were not taken advantage of immediately. Even with this new process and equipment, for example, the converters continue to use the same printing plate systems that had been used prior to the introduction of such flexographic printing system. This printing plate system generally consisted of a relatively thick rubber plate material secured to a fabric which in turn was secured to a carrier material.

In the late 1970's and the early 1980's, a significant change in the printing plate systems in use in the package printing industry finally occurred. It was at that time that the Roger's Corporation introduced the use of a cellular polyurethane material as a backing for flexographic printing plates. In this particular system, there is a flexible printing plate secured directly to the upper surface of such polyurethane material which, in turn, is glued to the working surface of the printing plate cylinder. The gluing of such polyurethane material to the printing plate cylinder may be accomplished with either an adhesive film or what is known in the industry as "sticky back tape". In some cases, such polyurethane material may be adhered to and supported on a polyester backing material. In either case, however, the printing plate is secured directly to the upper surface of such polyurethane material. This can create some problems due to the difference in the coefficients of expansion.

In view of the fact that the printing plate system is essentially glued to the working surface of the printing plate cylinder, it is obvious that great care must be exercised during mounting of such printing plate system to the working surface of the printing plate cylinder to insure accurate alignment.

In the prior art, it is also known, to use a substantially T-shaped member to accurately align and secure one end of a printing plate composite to a bar-like member. This bar-like member is disposed on such working surface of the printing plate cylinder in a position substantially parallel to the longitudinal axis thereof. The printing plate, in this case, is disposed on a vinyl-like sheet. A back surface of such vinyl-like sheet is engaged with at least a portion of the working surface of such printing plate cylinder. Such T-shaped member is secured to one end of the vinyl-like sheet and the axially opposed other end of such vinyl-like sheet is usually secured to the printing plate cylinder with tape or strap-like members. This particular fastening system for the printing plate is commonly known in the package printing industry as the Matthews Fast-Loc System. Use of the Matthews Fast-Loc System generally results in reduced down time of the press being required so that proper alignment of the printing plate on the working surface of the printing plate cylinder can be achieved.

Even though each of the above discussed improved printing plate systems have greatly advanced the state of the art in the printing of such substrate materials used in the packaging industry, each of these systems also have certain limitations connected with their use. For example, the Roger's printing plate system requires a considerable amount of time being expended in set up in the press. This is the case even though the Roger's system has the benefit that it enables a poor quality substrate material to be used and is not as sensitive to slight imperfections, which may be present, in the working surface of the printing plate cylinder. The Matthews Fast-Loc printing plate system, on the other hand, can be set up rather quickly on the press. However, the Matthews Fast-Loc system normally requires a higher quality substrate material be used and is less tolerant of slight imperfections being present in the working surface of such printing plate cylinder.

It is also well known in the prior art to use a plurality of equally spaced grommets secured to one end of a printing plate carrier sheet. Such grommets enable rapid aligning and securing of one end of such carrier sheet of a working surface of a printing plate cylinder. These grommets fit over protruding pins secured to the printing plate cylinder adjacent the working surface thereof, as with the Matthews Fast-Loc System, use of this system known in the industry as the Dorr "Rapi-Die" will result in a significant reduction of the down time required in the printing arrangement to achieve the necessary alignment of the printing plate on the working surface of such printing plate cylinder, however, this system has the same drawbacks in that higher quality substrate material must be used and fewer imperfections in the working surface of such printing plate cylinder can be tolerated.

SUMMARY OF THE INVENTION

In a first aspect, the present invention provides an apparatus that will enable a flexible printing plate member to be accurately positioned on and quickly secured to at least a predetermined portion of a working surface of a printing plate cylinder. Such printing plate cylinder being disposed in at least one print station of a printing arrangement. This apparatus includes a first substantially rectangular and generally flexible sheet-like member. This sheet-like member has each of a predetermined width, a predetermined length and a predetermined thickness. A bottom surface portion of such first sheet-like member is engageable with the predetermined portion of the working surface of such printing plate cylinder. There is a predetermined plurality of apertures formed through the first sheet-like member. Such apertures are disposed across a width dimension and adjacent one edge of the first sheet-like member. Each of such plurality of apertures have a first predetermined configuration. There is a predetermined plurality of generally rigid reinforcing means which have a shaft member that extends through each aperture. Such rigid reinforcing means being engageable with a portion of each of an upper surface portion and a bottom surface portion of the first sheet-like member for reinforcing such sheet-like member adjacent the apertures. Each such rigid reinforcing means includes an aperture formed therethrough. The aperture formed through such rigid reinforcing means receives a pin-like member therein. Such pin-like member is disposed adjacent the working surface of such printing plate cylinder and along a line parallel to a longitudinal axis of the printing plate cylinder. Such aperture formed through each of the rigid reinforcing means has a common axis with the aperture that is formed through the sheet-like member. In addition, the aperture formed through such rigid reinforcing means has a second predetermined configuration. The apparatus further includes a first substantially J-shaped hook-like member secured to the upper surface portion of such first sheet-like member. Such J-shaped hook-like member is disposed substantially across the width dimension of the sheet-like member and closely adjacent the plurality of apertures formed therein. Additionally, such first J-shaped hook-like member is located intermediate such plurality of apertures and an axially opposed second edge of such first sheet-like member. This first J-shaped hook-like member includes a first elongated substantially flat strip-like portion having each of first and second axially opposed edges and first and second axially opposed surfaces. One of such first and second axially opposed surfaces being engageable with and securable to such upper surface portion of such first sheet-like member adjacent such apertures. This first flat strip-like portion has a first predetermined length and a first predetermined width and a first predetermined thickness. The first J-shaped hook-like member includes a second elongated substantially flat strip-like portion having each of first and second axially opposed edges and first and second axially opposed surfaces. Such second flat strip-like portion has a second predetermined length and a second predetermined width and a second predetermined thickness. The final component of such first J-shaped hook-like member is a first elongated connecting strip-like portion having each of first and second axially opposed edges and first and second axially opposed surfaces. Such first edge of such first connecting strip-like portion is engaged with and secured to such first edge of such first flat strip-like portion and the second edge of such first connecting strip-like portion is engaged with and secured to the first edge of such second flat strip-like portion thereby forming the first J-shaped hook-like member. Such first connecting strip-like portion has a third predetermined length and a third predetermined width and a third predetermined thickness. The final essential component making up such apparatus is a first securing means engageable with the first flat strip-like portion and the first sheet-like member for securing such first J-shaped hook-like member to such upper surface portion of such first sheet-like member.

In a second aspect, the present invention provides an improved printing plate composite. Such printing plate composite possessing the capability of being accurately positioned on and quickly securable to at least a predetermined portion of a working surface of a printing plate cylinder that is disposed in at least one print station of a printing arrangement. Such printing plate composite comprising a first substantially rectangular and generally flexible sheet-like member. Such first sheet-like member including each of a predetermined width, a predetermined length and a predetermined thickness. A bottom surface portion of such first sheet-like member is engageable with such predetermined portion of the working surface of such printing plate cylinder. The first sheet-like member has an axially opposed upper surface portion. There is a predetermined plurality of apertures formed through such first sheet-like member across a width dimension thereof and adjacent one predetermined edge. Each of the plurality of apertures have a first predetermined configuration. The printing plate composite further includes a second substantially rectangular and generally flexible sheet-like member. Such second sheet-like member also having each of a predetermined width, a predetermined length and a predetermined thickness. Such second sheet-like member further has a bottom surface portion facing the upper surface portion of the first sheet-like member and an axially opposed upper surface portion. Furthermore, formed through the second sheet-like member there is a second predetermined plurality of apertures which extend across a width dimension and adjacent one edge thereof. Each of such plurality of apertures formed through the second sheet-like member have a second predetermined configuration. Further, each of the plurality of apertures formed through the first sheet-like member will be in axial alignment with each respective one of such second plurality of apertures formed through the second sheet-like member. A substantially rectangular and generally compressible sheet-like member is disposed between such upper surface of the first sheet-like member and the bottom surface portion of the second sheet-like member. This compressible member has a predetermined length, a predetermined width and a predetermined thickness, as well as an upper surface portion. A means is provided for securing such compressible member to one of such upper surface portion of the first sheet-like member and the bottom surface portion of the second sheet-like member. The printing plate composite also includes a predetermined plurality of generally rigid reinforcement means which have a shaft member that extends through each aperture formed through such first sheet-like member and such second sheet-like member. Such reinforcement means being engageable with a portion of each of the upper surface portion of the second sheet-like member and the bottom surface portion of the first sheet-like member adjacent such apertures. Each such reinforcement means includes an aperture formed therethrough which is capable of receiving therein a pin-like member disposed adjacent such working surface of the printing plate cylinder and along a line parallel to a longitudinal axis of such printing plate cylinder. The apertures formed through each of such rigid reinforcement means having a common axis with the apertures formed through such first sheet-like member and such second sheet-like member. Further, the aperture formed through each of such rigid reinforcement means having a third predetermined configuration. Finally, the printing plate composite includes a generally flexible printing plate member having a bottom surface thereof engageable with and securable to such upper surface portion of such second sheet-like member. This printing plate member will have predetermined indicia disposed on an upper surface portion thereof.

OBJECTS OF THE INVENTION

It is, therefore, one of the primary objects of the present invention to provide an apparatus which enables a printing plate member to be accurately positioned on and quickly secured to at least a predetermined portion of a working surface of a printing plate cylinder.

Another object of the present invention is to provide an apparatus having a compressible member incorporated therewith thereby enabling a poorer quality substrate material to be used in a printing operation without substantially sacrificing print quality.

Still another object of the present invention is to provide an apparatus capable of extending the useful life of a printing plate cylinder.

Yet another object of the present invention is to provide an apparatus which enables a printing plate to be secured to and removed from a printing plate cylinder in less time thereby improving the productivity of a printing arrangement.

A further object of the present invention is to provide an apparatus for use in a printing arrangement which will substantially minimize board crush normally encountered during a printing operation.

An additional object of the present invention is to provide an apparatus capable of being used with either a rubber printing plate or a photopolymer printing plate.

Still yet another object of the present invention is to provide an apparatus which will substantially extend the useful life of a printing plate.

Yet still another object of the present invention is to provide an apparatus for use on a printing plate cylinder which is capable of printing over low spots which may be present in a substrate material that will receive printed matter thereon.

A still further object of the present invention is to provide an improved apparatus which will enable a wide range of impression settings to be used in a print station without incurring detrimental effects in either the print quality or board crush.

Yet another object of the present invention is to provide an apparatus for use of a printing plate cylinder in which less down time will be required to make adjustments during a printing operation.

It is an additional object of the present invention to provide an apparatus which will result in fewer rejections of a finished printed product being required.

In addition to the numerous above described objects and advantages of the present invention, various other objects and advantages of the apparatus will become more readily apparent to those persons who are skilled in the printing art from the following more detailed description of the invention, particularly, when this description is taken in conjunction with the attached drawings and with the appended claims.

DESCRIPTION OF THE VARIOUS EMBODIMENTS OF THE INVENTION

Figure 1:
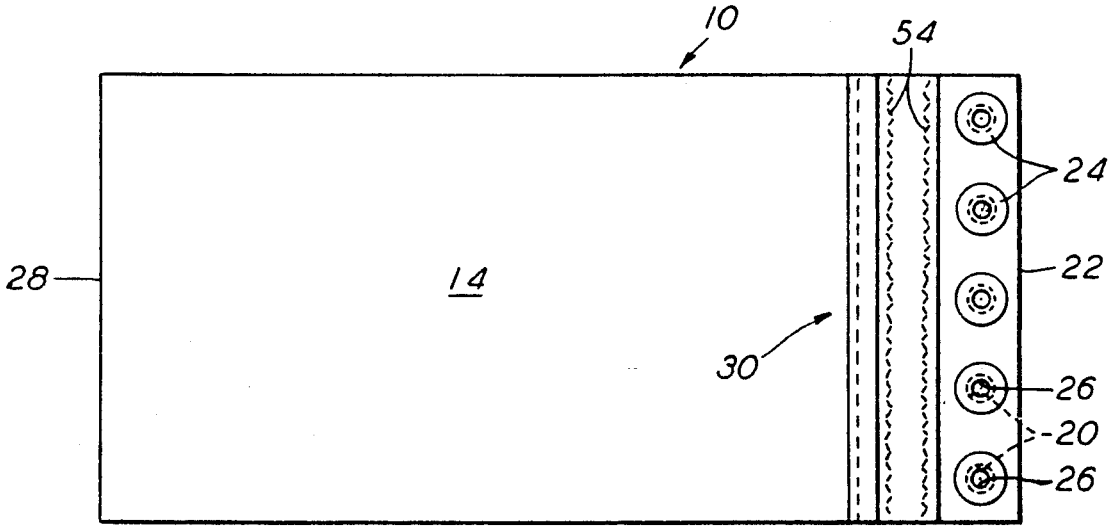
FIG. 1 is a plan view illustrating one presently preferred embodiment of a printing plate securing system.

Prior to proceeding to a more detailed description of the present invention, it should be noted that, for the sake of clarity, identical components having identical functions have been identified with identical reference numerals.

Figure 2:
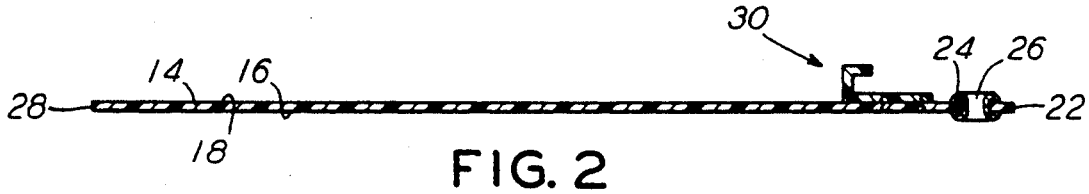
FIG. 2 is a cross-sectional view taken along the lines II—II of FIG. 1.
Figure 3:
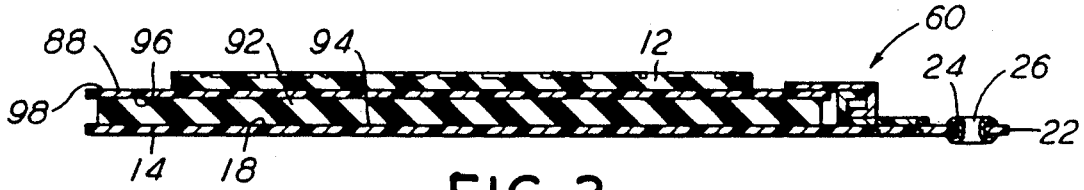
FIG. 3 is a cross-sectional view of a presently preferred printing plate composite assembled according to the present invention.

Now referring, more particularly, to FIGS. 1 and 2 in which there is illustrated an apparatus, generally designated 10, which enables a printing plate member 12 (FIGS. 3-6) to be accurately positioned on and quickly secured to at least a predetermined portion of a working surface (not shown) of a printing plate cylinder (not shown). Such printing plate cylinder being disposed in at least one print station (not shown) of a printing arrangement (not shown).

Such apparatus 10 includes a generally rectangular and generally flexible sheet-like member 14. This sheet-like member 14 has each of a predetermined width, a predetermined length and a predetermined thickness. Further, this sheet-like member 14 has a bottom surface portion 16 engageable with such predetermined portion of the working surface of the printing plate cylinder. The sheet-like member 14 has an axially opposed upper surface portion 18. In the presently preferred embodiment of the invention, such sheet-like member 14 is formed from a flexible plastic material. Such flexible plastic material, in the presently preferred embodiment, is mylar. Additionally, the predetermined thickness of such mylar sheet will preferably be between about 0.010 inch and about 0.030 inch.

The apparatus 10 further includes a predetermined plurality of apertures 20 formed through and across a width dimension of the sheet-like member 14. Such apertures 20 are disposed adjacent one edge 22 of the sheet-like member 14. Each of such plurality of apertures 20 have a first predetermined configuration which in the presently preferred embodiment of the invention is generally round. Such apertures 20 preferably are spaced substantially equidistant from one another.

Apparatus 10 further includes a plurality of generally rigid reinforcing means 24. Such reinforcing means 24 have a shaft member that extends through each aperture 20 formed in the sheet-like member 14. Each reinforcing means 24 is engageable with a portion of each of the upper surface portion 18 and the bottom surface portion 16 of the first sheet-like member 14. The rigid reinforcing means 24 provides a requisite amount of reinforcing of such first sheet-like member 14 in the area adjacent the aperture 20. Further, each such rigid reinforcing means 24 includes an aperture 26 formed therethrough. Received within the aperture 26 of the rigid reinforcing means 24 is a pin-like member (not shown) that is disposed adjacent the working surface of such printing plate cylinder. The series of pin-like members are located along a line parallel to a longitudinal axis of such printing plate cylinder. The aperture 26 formed through each of such rigid reinforcing means 24 shares a common axis with such aperture 20 that is formed through the sheet-like member 14. Also, the aperture 26 formed through the rigid reinforcing means 24 has a second predetermined configuration which, according to the presently preferred embodiment of the invention, will be generally round. Furthermore, according to the present invention, such rigid reinforcing means 24 can be made from plastic, metal, or a combination of plastic and metal. In the most preferred practice of the invention, the rigid reinforcing means 24 will be metal in the form of a grommet.

Another essential element of the apparatus 10 is a first substantially J-shaped hook-like member, generally designated 30. Such J-shaped hook-like member 30 is secured to the axially opposed upper surface portion 18 of such first sheet-like member 14 substantially across the width of such sheet-like member 14 as well as closely adjacent the plurality of apertures 20. Such first J-shaped hook-like member is disposed intermediate the plurality of apertures 20 and an axially opposed second edge 28 of such first sheet-like member 14. The first J-shaped hook-like member 30 includes a first elongated substantially flat strip-like portion 32 having each of first and second axially opposed edges 34 and 36, respectively, and first and second axially opposed surfaces 38 and 40 respectively. One of such first and second axially opposed surfaces 38 and 40 being engageable with and securable to such upper surface portion 18 of the first sheet-like member 14 adjacent the apertures 20. As illustrated in the drawings, such surface is the first surface 38 of the first flat strip-like portion 32. The first flat strip-like portion 32 has a first predetermined length and a first predetermined width and a first predetermined thickness. The first J-shaped hook-like member 30 also includes a second elongated substantially flat strip-like portion 42 having each of first and second axially opposed edges 44 and 46, respectively, and first and second axially opposed surfaces 48 and 50 respectively. Such second flat strip-like portion 42 has a second predetermined length and a second predetermined width and a second predetermined thickness. Finally, the first J-shaped hook-like member 30 includes a first elongated connecting strip-like portion 52 having each a first and second axially opposed edges and first and second axially opposed surfaces. Such first edge of the first connecting strip-like portion 52 is engaged with and secured to the first edge 34 of the first flat strip-like portion 32 and the second edge of such first connecting strip-like portion 52 is engaged with and secured to the first edge 44 of such second flat strip-like portion 42 thereby forming such first J-shaped hook-like member 30. Such first connecting strip-like portion 52 has a third predetermined length, a third predetermined width and a third predetermined thickness. In the presently preferred embodiment of the invention, such first predetermined length of such first flat strip-like portion 32 is substantially identical to such predetermined width of the first sheet-like member 14. It can also be stated that, in the preferred embodiment of the invention, the first predetermined length of such first flat strip-like portion 32 and such second predetermined length of such second flat strip-like portion 42 and such predetermined length of such first connecting strip-like portion 52 are all substantially identical. Although such first flat strip-like portion 32 and such second flat strip-like portion 42 and the first connecting strip-like portion 52 could be formed as individual elements and then secured together such as by gluing, welding, etc., it is presently preferred that they be formed integraliy as a single piece. It would normally be preferred that such single piece be formed as an extruded plastic J-shaped hook-like member 30. Another essential element of the apparatus 10 is a first securing means 54 which is engageable with the first flat strip-like portion 42 and such first sheet-like member 14 for securing the J-shaped hook-like member 30 to the upper surface portion 18 of such first sheet-like member 14. Such first securing means 54 is illustrated in the drawings as stitching but it should be understood that the first securing means 54 could also be an adhesive for example.

In the presently preferred embodiment of the invention, the printing plate securing apparatus 10 will further include a second substantially J-shaped hook-like member, generally designated 60. Such second J-shaped hook-like member 60 includes a third elongated substantially flat strip-like portion 56 having each of first and second axially opposed edges 58 and 62, respectively, and first and second axially opposed surfaces 64 and 66, respectively. Such third flat strip-like portion 56 has a fourth predetermined length and a fourth predetermined width and a fourth predetermined thickness. The J-shaped hook-like member 60 also includes a fourth elongated substantially flat strip-like portion 68 having each of first and second axially opposed edges 70 and 72, respectively, and first and second axially opposed surfaces 74 and 76, respectively. Such fourth flat strip-like portion 68 has a fifth predetermined length and a fifth predetermined width and a fifth predetermined thickness. A second elongated connecting strip-like portion 78 is the final essential element of the J-shaped hook-like member 60. Such second connecting strip-like portion 78 has each of first and second axially opposed edges 80 and 82, respectively, and first and second axially opposed surfaces 84 and 86, respectively. The first edge 80 of the second connecting strip-like portion 78 is engaged with and secured to the first edge 58 of the third flat strip-like portion 56. The second edge 82 of such second connecting strip-like portion 78 is engaged with and secured to the first edge 70 of such fourth flat strip-like portion 68 thereby forming the second J-shaped hook-like member 60. The first surface 84 of the second connecting strip-like portion 78 is disposable adjacent the second edge 46 of such second flat strip-like portion 42 and the second edge 72 of such fourth flat strip-like portion 68 is disposable adjacent the first surface of such first connecting strip-like portion 52. The second connecting strip-like portion 78 has a sixth predetermined width and a sixth predetermined length and a sixth predetermined thickness. Engageable with and securable to one of such first and second axially opposed surfaces 64 and 66 of the third flat strip-like portion 56 of such second J-shaped hook-like member 60 adjacent one edge and across a width dimension thereof is a second substantially rectangular and generally flexible sheet-like member 88. Such second flexible sheet-like member 88 having each of a predetermined width, a predetermined length and a predetermined thickness. A means 90 for securing this second flexible sheet-like member 88 to such one of such first and second axially opposed surfaces 64 and 66 of such third flat strip-like portion 56 of the second J-shaped hook-like member 60 is provided. Such means 90 may be an adhesive or stitching. There is a generally rectangular compressible member 92 engageable with an upper surface 18 of such first flexible sheet-like member 14 and a bottom surface 96 of such second flexible sheet-like member 88. Such compressible member 92 having a predetermined length, a predetermined width and a predetermined thickness. Also provided is a means 94, such as an adhesive, for securing the compressible member 92 to one of such upper surface 18 of such first flexible sheet-like member 14 and such bottom surface 96 of the second flexible sheet-like member 88. In the presently preferred embodiment, the compressible member 92 is a cellular polyurethane material which has a predetermined density and the second flexible sheet-like member 88 is formed from a vinyl material. The apparatus 10 further includes at least one printing plate member 12, formed from one of rubber and a photopolymer material, secured to an upper surface of such second flexible sheet-like member 88. Such printing plate member 12 is preferably secured to the upper surface 98 of the second flexible sheet-like member 88 by an adhesive.

Figure 4:
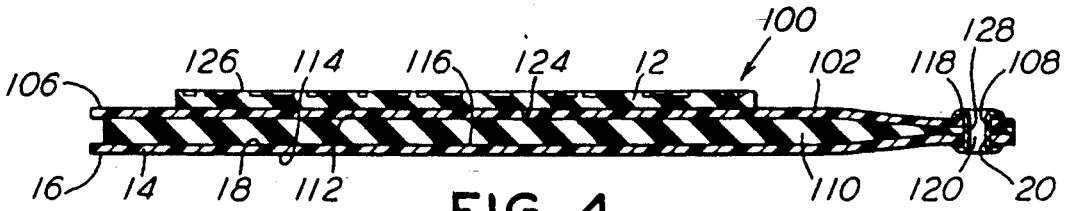
FIG. 4 is a cross-sectional view illustrating an alternative embodiment of a printing plate composite assembled according to the present invention.
Figure 5:
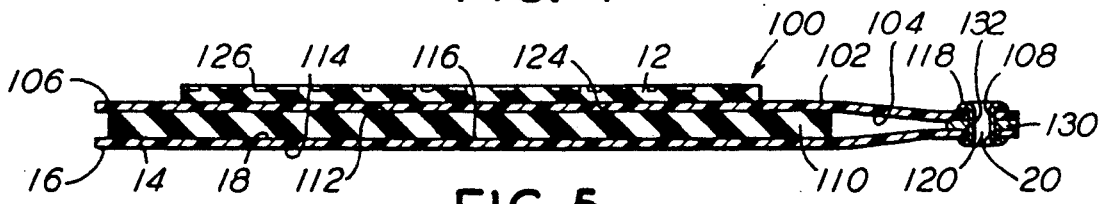
FIG. 5 is a cross-sectional view of an alternative embodiment of a printing plate cylinder assembled according to the present invention.
Figure 6:
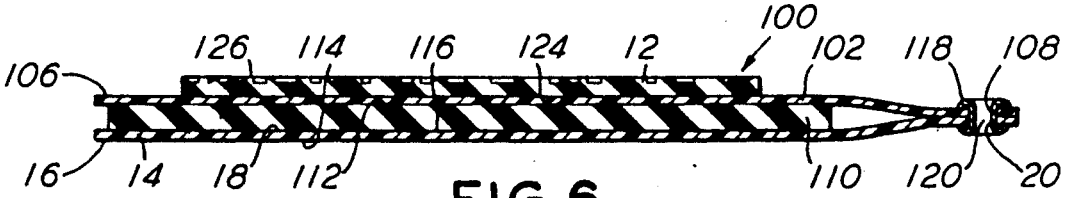
FIG. 6 is a cross-sectional view of still yet another alternative embodiment of a printing plate composite assembled according to the present invention.
Figure 7:
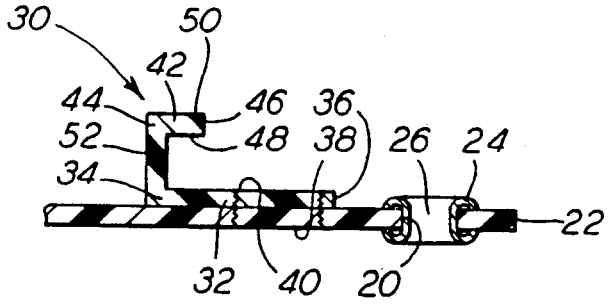
Figure 8:
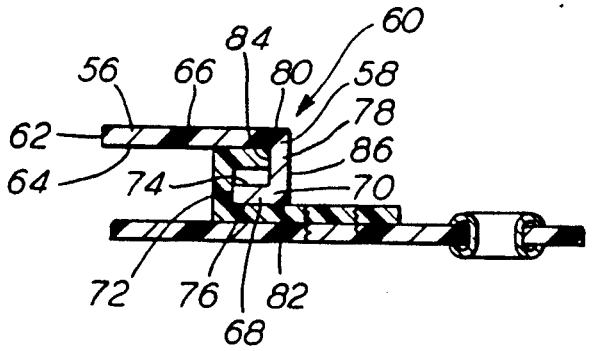

Alternatively, the present invention provides an improved printing plate composite, generally designated 100 and best seen in FIGS. 4–6. Such printing plate composite 100 is capable of being accurately positioned onto at least a predetermined portion of a working surface of a printing plate cylinder as well as being capable of being quickly secured thereto. The printing plate composite 100 includes a first substantially rectangular and generally flexible sheet-like member 14 which has each of a predetermined width, a predetermined thickness and a predetermined length. Such first sheet-like member 14 further having a bottom surface portion 16 engageable with such predetermined portion of the working surface of such printing plate cylinder and an axially opposed upper surface 18.

There is a predetermined plurality of apertures 20 formed through such first sheet-like member 14 across a width dimension and adjacent one edge thereof. Each of such plurality of apertures 20 has a first predetermined configuration, which in a presently preferred embodiment, would be generally round. Such printing plate composite 100 further includes a second substantially rectangular and generally flexible sheet-like member 102. This second sheet-like member 102 has each of a predetermined width, a predetermined length and a predetermined thickness. Further, such second sheet-like member 102 has a bottom surface portion 104 facing such upper surface portion 18 of the first sheet-like member 14 and an axially opposed upper surface portion 106. There is another predetermined plurality of apertures 108 formed through the second sheet-like member 102 across a width dimension and adjacent one edge thereof. Each of such plurality of apertures 108 formed through the second sheet-like member 102 has a second predetermined configuration which, in a presently preferred embodiment, is also generally round. Each of such plurality of apertures 20 formed through the first sheet-like member 14 are disposed in axial alignment with a respective one of such plurality of apertures 108 formed through the second sheet-like member 102.

The improved printing plate composite 100 further includes a substantially rectangular and generally compressible sheet-like member 110 disposed between such upper surface 18 of the first sheet-like member 14 and the bottom surface portion 104 of the second sheet-like member 102. This compressible member 110 has a predetermined length, a predetermined width and a predetermined thickness. Such compressible member 110 having axially opposed upper and bottom surface portions 112 and 114 respectively.

There is a means 116 provided for securing such compressible member 110 to one of such upper surface portion 18 of the first sheet-like member 14 and such bottom surface portion 104 of the second sheet-like member 102. In the presently preferred embodiment of the invention, such means 116 for securing such compressible member 110 to either the first sheet-like member 14 or the second sheet-like member 102 will be an adhesive, such as, sticky-back tape. Also provided in the printing plate composite 100 is a predetermined plurality of generally rigid reinforcement means 118 which have a shaft member that extends through each aperture formed in both the first sheet-like member 14 and the second sheet-like member 102. Such rigid reinforcing means 118 are engageable with a portion of each of such upper surface portion !06 of the second sheet-like member 102 and the bottom surface portion 16 of such first sheet-like member 14 adjacent the apertures 20 and 68 respectively. Each such rigid reinforcing means 118 including an aperture !20 formed therethrough for receiving a pin-like member (not shown) disposed adjacent such working surface (not shown) of such printing plate cylinder (not shown) and along a line parallel to a longitudinal axis of such printing plate cylinder. The aperture 120 formed through each of such rigid reinforcing means 118 has a common axis with the aperture 20 formed through the first sheet-like member 14 and the aperture 108 formed through the second sheet-like member 102. Such aperture 120 formed through each of the reinforcing means 118 has a third predetermined configuration which, in the presently preferred embodiment of the invention, is generally round. The final essential element of the printing plate composite 100, in this embodiment of the invention, is a generally flexible printing plate member 12 having a bottom surface portion 124 thereof engageable with and securable to the upper surface portion 106 of the second sheet-like member 102. Such printing plate member 12 has a predetermined indicia 126 disposed on an upper surface thereof. In a presently preferred form of the invention described with respect to FIGS. 3 and 6, the first sheet-like member 14 is formed from a polyester material which preferably would be mylar. Also, the compressible sheet-like member 110 will be formed from a cellular polyurethane material and the second sheet-like member 102 will be formed from a vinyl sheet.

Preferably, the compressible member 110 will be secured to the upper surface portion 18 of the first sheet-like member 14. It should also be noted that, in the presently preferred embodiment of the invention, the predetermined width of the second sheet-like member 102 and the compressible member 110 will be substantially identical. In the embodiment of the invention illustrated in FIGS. 5 and 6, it can be seen that the predetermined length of such compressible material 110 will be less than the predetermined length of such first sheet-like member 14 and the second sheet-like member 102. On the other hand, as can be seen in FIG. 4, such compressible member 110 includes a predetermined plurality of apertures 128 formed therethrough adjacent one edge thereof. Each of such plurality of apertures 128 formed through such compressible member 110 is in axial alignment with a respective one of such apertures 20 and 108 formed in each of such first sheet-like member 14 and such second sheet-like member 102. As discussed above with respect to the invention shown in FIG. 3, such cellular polyurethane material will have a predetermined density. Further, the predetermined thickness of such cellular polyurethane material will be in a range of between about 0.120 inch and about 0.10 inch. Also, it should be noted that, the printing plate member 12 can be manufactured from either rubber or photopolymer for most applications photopolymer would be preferred. As can be seen in FIG. 5, the printing plate composite 100 further includes a spacer member 130 disposed intermediate the upper surface portion 18 of the first sheet-like member 14 and bottom surface portion 114 of the second sheet-like member 102. The spacer member 130 includes a plurality of apertures 132 formed therethrough. The spacer member 130 is held in place by the rigid reinforcing means 118. It is presently preferred that the spacer member 130 will be formed from a plastic-like material and that the rigid reinforcing means would be formed from one of plastic, metal and a combination of plastic and metal. The printing plate composite 100 will generally have a total thickness of between about 0.260 inch and about 0.280 inch.

While a number of embodiments have been shown in the drawings and discussed in detail above, it should be obvious to those persons who are skilled in the printing art that various other modifications and adaptations of the present invention can be made without taking from the spirit and scope of the appended claims.

I claim:

1. An apparatus which enables a flexible printing plate member to be accurately positioned on and quickly secured to at least a predetermined portion of a working surface of a printing plate cylinder, having a pin-like member, disposed in at least one print station of a printing arrangement, said apparatus comprising:

(a) a first substantially rectangular and generally flexible sheet-like member, said first sheet-like member having each of a predetermined width, a predetermined length and a predetermined thickness, said first sheet-like member further having a bottom surface portion engageable with such predetermined portion of such working surface of such printing plate cylinder and an axially opposed upper surface portion;

(b) a predetermined plurality of apertures formed through said first sheet-like member across a width dimension and adjacent one edge thereof, each of said plurality of apertures having a first predetermined configuration;

(c) a predetermined plurality of generally rigid reinforcing means having a shaft member extending through each aperture and being engageable with a portion of each of said upper surface portion and said bottom surface portion of said first sheet-like member for reinforcing said first sheet-like member adjacent said apertures, each said rigid reinforcing means including an aperture formed therethrough for receiving therein such pin-like member, disposed adjacent such working surface of such printing plate cylinder and along a line parallel to a longitudinal axis of such printing plate cylinder, said aperture formed through said each of said rigid reinforcing means having a common axis with said aperture formed through said sheet-like member and a second predetermined configuration;

(d) a first substantially J-shaped hook-like member secured to said axially opposed upper surface portion of said first sheet-like member substantially across said width dimension and closely adjacent said plurality of apertures, said first J-shaped hook-like member being disposed intermediate said plurality of apertures and an axially opposed second edge of said first sheet-like member, said first J-shaped hook-like member including, (i) a first elongated flat strip-like portion having each of first and second axially opposed edges and first and second axially opposed surfaces, one of said first and second axially opposed surfaces being engageable with and securable to said upper surface portion of said first sheet-like member adjacent said apertures, said first flat strip-like portion having a first predetermined length and a first predetermined width and a first predetermined thickness, (ii) a second elongated substantially flat strip-like portion having each of first and second axially opposed edges and first and second axially opposed surfaces, said second flat strip-like portion having a second predetermined length and a second predetermined width and a second predetermined thickness, and (iii) a first elongated connecting strip-like portion having each of a first and second axially opposed edges and first and second axially opposed surfaces, said first edge of said first connecting strip-like portion is engaged with and secured to said first edge of said first flat strip-like portion and said second edge of said first connecting strip-like portion is engaged with and secured to said first edge of said second flat strip-like portion thereby forming said first J-shaped hook-like member, said first connecting strip-like portion having a third predetermined length and third predetermined width and third predetermined thickness, and (e) a first securing means engageable with said first flat strip-like portion and said first sheet-like member for securing said first J-shaped hook-like member to said upper surface portion of said first sheet-like member.

2. A printing plate securing apparatus according to claim 1, wherein said first sheet-like member is formed from a flexible mylar material.

3. A printing plate securing apparatus according to claim 1, wherein said predetermined thickness of said first sheet-like material is between about 0.010 inch and 0.030 inch.

4. A printing plate securing apparatus according to claim 1, wherein said plurality of apertures formed through said first sheet-like member are spaced substantially equidistant from one another.

5. A printing plate securing apparatus according to claim 4, wherein said each of said rigid reinforcing means is one of plastic and metal.

6. A printing plate securing apparatus according to claim 1, wherein said first predetermined length of said first flat strip-like portion is substantially identical to said predetermined width of said first sheet-like member.

7. A printing plate securing apparatus according to claim 6, wherein said first predetermined length of said first flat strip-like portion and said second predetermined length of said second flat strip-like portion and said predetermined length of said first connecting strip-like portion are substantially identical.

8. A printing plate securing apparatus according to claim 7, wherein said first flat strip-like portion and said second flat strip-like portion and said first connecting strip-like portion are extended plastic formed integrally as a single piece.

9. A printing plate securing apparatus according to claim 1, wherein said first securing means engageable with said first flat strip-like portion and said first sheet-like member is stitching.

10. A printing plate securing apparatus according to claim 1, wherein said apparatus further includes;

(a) a second substantially J-shaped hook-like member, said second J-shaped hook-like member including, (i) a third elongated substantially flat strip-like portion having each of first and second axially opposed edges and first and second axially opposed surfaces, said third flat strip-like portion having a fourth predetermined length and a fourth predetermined width and a fourth predetermined thickness, (ii) a fourth elongated substantially flat strip-like portion having each of first and second axially opposed edges and first and second axially opposed surfaces, said fourth flat strip-like portion having a fifth predetermined length and a fifth predetermined width and a fifth predetermined thickness, and (iii) a second elongated connecting strip-like portion having each of first and second axially opposed edges and first and second axially opposed surfaces, said first edge of said second connecting strip-like portion is engaged with and secured to said first edge of said third flat strip-like portion and said second edge of said second connecting strip-like portion is engaged with and secured to said first edge of said fourth flat strip-like portion, thereby forming said second J-shaped hook-like member, said first surface being disposable adjacent said second edge of said second flat strip-like portion and said second edge of said fourth flat strip-like portion being disposable adjacent said first surface of said first connecting strip-like portion, said second connecting strip-like portion having a sixth predetermined width and a sixth predetermined thickness;

(b) a second substantially rectangular and generally flexible sheet-like member, said second flexible sheet-like member having each of a predetermined width a predetermined length and a predetermined thickness, said second flexible sheet-like member being engageable with and secured to one of said first and second axially opposed surfaces of said third flat strip-like portion of said second J-shaped hook-like member adjacent one edge thereof and across a width dimension;

(c) means for securing said second flexible sheet-like member to said one of said first and second axially opposed surfaces of said third flat strip-like portion of said second J-shaped hook-like member;

(d) a generally rectangular compressible member engageable with an upper surface of said first flexible sheet-like member and a bottom surface of said second flexible sheet-like member, said compressible member having a predetermined length, a predetermined width and a predetermined thickness; and (e) means for securing said compressible member to one of said upper surface of said first flexible sheet-like member and said bottom surface of said second flexible sheet-like member.

11. An improved printing plate composite which can be accurately positioned on and quickly secured to at least a predetermined portion of a working surface of a printing plate cylinder, having a pin-like member, disposed in at least one print station of a printing arrangement, said printing plate composite comprising:

(a) a first substantially rectangular and generally flexible sheet-like member, said firs sheet like member having each of a predetermined with, a predetermined length and a predetermined thickness, said first sheet-like member further having a bottom surface portion engageable with such predetermined portion of such working surface of such printing plate cylinder and an axially opposed upper surface portion;

(b) a predetermined plurality of apertures formed through said first sheet-like member across a width dimension and adjacent one edge thereof, each of said plurality of apertures having a first predetermined configuration;

(c) a second substantially rectangular and generally flexible sheet-like member, said second sheet-like member having each of a predetermine width, a predetermined length and a predetermined thickness, said second sheet-like member further having a bottom surface portion facing said upper surface portion of said first sheet-like member and in an axially opposed upper surface portion;

(d) a predetermined plurality of apertures formed through said second sheet-like member across a width dimension and adjacent one edge thereof, each of said plurality of apertures formed through said second sheet-like member having a second predetermined configuration, each of said plurality of apertures formed through said first sheet-like member being in axially alignment with a respective one of said plurality of apertures formed through said second sheet-like member;

(e) a substantially rectangular and generally compressible sheet-like member disposed between said upper surface of said first sheet-like member and said bottom surface portion of said second sheet-like member, said compressible member having a predetermined length, a predetermined width and a predetermined thickness, said compressible member having axially opposed upper and bottom surface portions;

(f) means for securing said compressible member to one of said upper surface portion of said first sheet-like member and said bottom surface portion of said second sheet-like member;

(g) a predetermined plurality of generally rigid reinforcement means having a shaft member extending through each aperture formed in said first sheet-like member and said second sheet-like member and being engageable with a portion of each of said upper surface portion of said second sheet-like member and said bottom surface portion of such first sheet-like member for reinforcing said first sheet-like member and said second sheet-like member adjacent said apertures, each said rigid reinforcement means including an aperture formed therethrough for receiving therein such pin-like member disposed adjacent such working surface of such printing plate cylinder and along a line parallel to a longitudinal axis of such printing plate cylinder, said aperture formed through said each of said rigid reinforcement means having a common axis with said aperture formed through said first sheet-like member and said aperture formed through said second sheet-like member, said aperture formed through said each of said rigid reinforcement means having a third predetermined configuration; and (h) a generally flexible printing plate member having a bottom surface thereof engageable with and securable to said upper surface portion of said second sheet-like member, said printing plate member having predetermined indicia disposed on an upper surface thereof.

12. A printing plate composite according to claim 11, wherein said compressible sheet-like member is a cellular polyurethane material.

13. A printing plate composite according to claim 12, wherein said means for securing said compressible member to said one of said upper surface portion of said first sheet-like member and said bottom surface portion of said second sheet-like member is an adhesive.

14. A printing plate composite according to claim 13, wherein said compressible member is secured to said upper surface portion of said first sheet-like member.

15. A printing plate composite according to claim 1, wherein said compressible member includes a predetermined plurality of apertures formed therethrough adjacent one edge thereof, each of said plurality of apertures formed through said compressible member is in axial alignment with a respective one of said apertures formed in each of said first sheet-like member and said second sheet-like member.

16. A printing plate composite according to claim 12, wherein said predetermined thickness of said cellular polyurethane material is in a range of between about 0.120 and about 0.10 inch.

17. A printing plate composite according to claim 11, wherein said printing plate member is photopolymer.

18. A printing plate composite according to claim 11, wherein said printing plate composite has a total thickness of between about 0.260 inch and about 0.280 inch.

19. A printing plate composite according to claim 11, wherein said first predetermined configuration and said second predetermined configuration and said third predetermined configuration are generally round.

20. A printing plate composite according to claim 19, wherein said rigid reinforcing means is one of plastic, metal, and a combination of plastic and metal.

* * * * *

UNITED STATES PATENT AND TRADEMARK OFFICE

CERTIFICATE OF CORRECTION

PATENT NO. : 5,088,408

DATED : February 18, 1992

INVENTOR(S) : Ivan N. Philpot

It is certified that error appears in the above-identified patent and that said Letters Patent is hereby corrected as shown below:

Column 10, line 34, delete "!06", and insert --106--.

Column 10, line 38, delete "!20", and insert --120--.

Column 11, line 9, delete "1!0", and insert --110--.

Column 11, line 22, delete "!2",and insert --12--.

Column 14, line 25, delete "firs", and insert --first--.

Column 15, line 12, delete "such", and insert --a--.

Column 16, line 9, delete "1",and insert --11--.

Signed and Sealed this

First Day of June, 1993

*Attest:*

Michael K. Kirk

MICHAEL K. KIRK

*Attesting Officer*

*Acting Commissioner of Patents and Trademarks*